US006574984B1

(12) United States Patent
McCrea et al.

(10) Patent No.: US 6,574,984 B1
(45) Date of Patent: Jun. 10, 2003

(54) REFRIGERATOR DOOR MOUNTED WATER DISPENSING ASSEMBLY

(75) Inventors: Michael James McCrea, Ancaster (CA); Dave Brown, Hamilton (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 10/067,210

(22) Filed: Feb. 7, 2002

(51) Int. Cl.[7] ..... F25D 19/00; F25D 11/02; B67D 5/62; A47B 96/04

(52) U.S. Cl. ..... 62/449; 62/389; 62/391; 62/397; 62/441; 312/404; 312/407; 222/146.6

(58) Field of Search ..... 62/397, 391, 389, 62/441, 449; 312/404, 407; 222/146.6

(56) References Cited

U.S. PATENT DOCUMENTS

| | | | | | |
|---|---|---|---|---|---|
| 2,982,114 | A | | 5/1961 | Cobb et al. | 62/338 |
| 3,069,869 | A | * | 12/1962 | Mueller | 62/371 |
| 3,220,558 | A | | 11/1965 | Olsson | 211/74 |
| 3,227,502 | A | | 1/1966 | Roberts | 312/214 |
| 3,682,521 | A | | 8/1972 | Kesling | 312/138 A |
| 3,807,822 | A | | 4/1974 | Amore | 312/138 A |
| 3,914,957 | A | | 10/1975 | Jacobs | 62/338 |
| 4,306,971 | A | * | 12/1981 | Hankammer | 210/282 |
| 4,514,994 | A | * | 5/1985 | Mabb | 222/399 |
| 4,859,010 | A | | 8/1989 | Jeziorowski | 312/312 |
| 4,908,544 | A | * | 3/1990 | Lau | 312/321.5 |
| 5,004,305 | A | | 4/1991 | Montuoro et al. | 312/214 |
| 5,042,398 | A | | 8/1991 | Lau et al. | 108/108 |
| 5,077,985 | A | * | 1/1992 | Buchser et al. | 222/146.6 |
| 5,156,021 | A | | 10/1992 | St-Gelais et al. | 62/382 |
| D336,760 | S | | 6/1993 | Raunkjaer | D23/209 |
| 5,226,717 | A | | 7/1993 | Hoffman | 312/405.1 |
| RE34,377 | E | | 9/1993 | Wilkins et al. | 312/245 |
| 5,290,442 | A | * | 3/1994 | Clack | 210/257.1 |
| 5,322,366 | A | | 6/1994 | Revlett et al. | 312/405.1 |
| 5,346,299 | A | * | 9/1994 | Werkmeister et al. | 312/405.1 |
| 5,370,455 | A | | 12/1994 | Sedovic et al. | 312/405.1 |
| 5,375,924 | A | | 12/1994 | Pohl et al. | 312/405.1 |
| 5,454,944 | A | | 10/1995 | Clack | 210/257.1 |
| 5,560,393 | A | | 10/1996 | Clack | 137/562 |
| 5,567,029 | A | | 10/1996 | Haenisch et al. | 312/405.1 |
| 5,685,624 | A | | 11/1997 | Lee | 312/405.1 |
| 5,791,523 | A | * | 8/1998 | Oh | 222/146.6 |
| 5,813,246 | A | * | 9/1998 | Oh | 137/614.04 |
| 6,003,734 | A | * | 12/1999 | Oh | 141/351 |
| 6,050,097 | A | | 4/2000 | Nelson et al. | 62/137 |
| 6,079,221 | A | | 6/2000 | Senner | 62/338 |
| 6,231,146 | B1 | | 5/2001 | Dang | 312/405.1 |

* cited by examiner

*Primary Examiner*—William C. Doerrler
*Assistant Examiner*—Filip Zec

(57) ABSTRACT

A portable water dispensing module is mounted to a refrigerator door inner liner. The liner has side walls with aligned vertically spaced module supports. The water dispensing module comprises a reservoir having a fill chamber located above a main reservoir. The fill chamber has a lid that has an opening closed by a cap. The reservoir supports the fill chamber and has side walls with anchoring supports that releasably and matingly engage with the module supports on the liner side walls to mount the water dispensing module against the liner walls. A lower recessed portion of the front wall of the reservoir protects a spigot, mounted into the recess, from inadvertent contact with a user. The reservoir further includes recessed handle portions on the side walls located forward of the refrigerator door liner side walls and below the fill chamber to facilitate the portability of the water dispensing module from the refrigerator door. The combined use of the fill chamber with the reservoir and the use of a filter in between permits for a relatively large volume of water to be stored in the water dispensing module on the inside of the refrigerator door without the use of any plumbing water lines having to pass through the refrigerator door. Further, when the door is closed, the water contained within the water dispensing module is chilled to provide a supply of filtered chilled water for a user.

14 Claims, 3 Drawing Sheets

REFRIGERATOR DOOR MOUNTED WATER DISPENSING ASSEMBLY

TECHNICAL FIELD OF THE INVENTION

The present invention relates to a refrigerator door mounted portable water dispenser removably mounted to the inner liner of the refrigerator door and accessible for dispensing water when the door is open.

BACKGROUND OF THE INVENTION

Modern day refrigerators typically include door mounted modules, such as bins, drawers, trays or shelves used to store numerous items which are handy to a user. In the past several years a number of schemes or assemblies have been introduced to provide greater flexibility by enabling the user to selectively mount different modules at numerous locations on the inner liner of the door, particularly on the fresh food compartment door. Usually, the portable mounting involves ribs, recesses, apertures or bosses mounted along opposing side support walls of the door liner and corresponding mating or anchoring supports on the drawers or bins.

Examples of refrigerator door module mounting assemblies are shown in U.S. Pat. No. 5,346,299 issued Sep. 13, 1994 to Werkmeister et al; U.S. Pat. No. 3,220,558 issued Nov. 30, 1965 to Olsson; U.S. Pat. No. 5,685,624 issued Nov. 11, 1997 to Lee; U.S. Pat. No. 3,227,502 issued Jan. 4, 1996 to Roberts; U.S. Pat. No. 3,682,521 issued Aug. 8, 1972 to Kesling; U.S. Pat. No. 3,807,822 issued Apr. 30, 1974 to Amore; U.S. Pat. No. 4,859,010 issued Aug. 22, 1989 to Jeziorowski; U.S. Pat. No. 4,908,544 issued Mar. 13, 1990 to Lau; U.S. Pat. No. 5,004,305 issued Apr. 2, 1991 to Montuoro et al.; U.S. Pat. No. 5,042,398 issued Aug. 27, 1991 to Lau et al.; Re. Pat. No. 34,377 reissued Sep. 14, 1993 to Wilkins et al.; U.S. Pat. No. 5,322,366 issued Jun. 21, 1994 to Revlett et al.; U.S. Pat. No. 5,226,717 issued Jul. 13, 1993 to Hoffman; U.S. Pat. No. 5,370,455 issued Dec. 6, 1994 to Sedovic et al.; U.S. Pat. No. 5,375,924 issued Dec. 27, 1994 to Pohl et al.; U.S. Pat. No. 5,567,029 issued Oct. 22, 1996 to Haenisch et al.; and U.S. Pat. No. 6,231,146 issued May 15, 2001 to Dang.

While door shelves and bins are utilized to support many items such as a water jug resting in or on the shelf, refrigerators having a water dispensing feature require a water dispenser incorporated with the door that typically extends through the door providing access to a user from the outer panel of a closed refrigerator door. These through the door mounted water dispensers typically involve placing a water line into the door and connecting the water line with a faucet or valve actuated by a lever accessible to a user from outside the door. The costs associated with the plumbing connections and door construction for a through the door mounted water dispenser are much higher than simply buying a water jug and placing it onto a shelf in the refrigerator.

Portable water dispensers or jugs have been filled with water and placed on a shelf within the refrigerator fresh food compartment or, for much smaller jugs, on a door shelf. The jugs used on the door shelf or bin are much smaller due to the space requirements of the door shelf and non-tipping requirements of the jug placed on the door shelf. However, due to the weight of a filled water jug located on the door shelf, care must be taken when closing the door in order not to upset the jug and cause spillage. For larger volume water jugs, they must be placed on a shelf within the refrigerator cabinet. Some of these jugs include a filter for removing un-wanted chemicals from the water poured into the jug. However, jugs placed on a shelf in the refrigerator cabinet typically occupy a considerable amount of space that could be otherwise used for food storage and are heavy to load onto the shelf.

There is a need for a water dispenser that does not require through the door plumbing connections, has a relative large volume, is portable, and is adapted for secure removable mounting to the refrigerator door thereby being less prone to spillage and freeing up space within the fresh food compartment for storage of other food items.

SUMMARY OF THE INVENTION

The present invention relates to a refrigerator door mounted water dispensing apparatus comprising a water dispensing module portably mounted relative to the inner liner of a refrigerator door. The refrigerator door has an outer shell and an inner liner. The inner liner has at least two spaced apart liner side walls and a rear liner wall extending between the liner side walls that defines a liner recess. The liner side walls have aligned and vertically spaced module supports. The water dispensing module is at least partially receivable within the liner recess and has a reservoir defined by a front wall portion, opposing side wall portions, a rear wall portion and a bottom wall portion. Each of the reservoir side wall portions has at least one anchoring support for releasably mating with the module supports of the liner side walls to mount the water dispensing module on the refrigerator door with the reservoir rear wall portion adjacent the liner rear wall and the reservoir side wall portions adjacent the corresponding liner side walls. The reservoir front wall portion extends across the refrigerator door between the liner side walls. The water dispensing module further has a spigot that is mounted to the reservoir front wall portion adjacent the reservoir bottom wall portion to permit for the dispensing of the water from the reservoir when the refrigerator door is open.

The releasable mating of the water dispensing module with the liner permits for the water dispenser to be releasably mounted directly to a refrigerator door. Further, the spigot permits for water to be dispensed from the reservoir when the door is opened. Since the water dispensing module is an independent unit mounted to the inside door liner, there is no requirement for plumbing a water line in the door and for the spigot to be accessible from outside the refrigerator door as in a through the door dispenser. Further, the reservoir is readily accessibly when the door of the refrigerator is open hence the water contained within the reservoir will provide a supply of chilled water for a user.

In a preferred construction, the refrigerator liner side walls each have has a series of liner module supports vertically spaced along each of the liner side walls which allow for the water dispensing module to be inserted vertically relative to the refrigerator door. As a result, the water dispensing module may be located at a desired height allowing it to be readily filled while still mounted on the refrigerator door or to be easily removed from the refrigerator door for filling at a remote location.

Preferably, the front wall portion of the reservoir has a recess located adjacent to the reservoir bottom wall into which the spigot is mounted substantially rearwardly of the front wall. This rearward mounting of the spigot relative to the front wall portion prevents the spigot from coming into contact with other food articles within the food chamber when the door is closed. Further, there is less chance of a user catching accidentally touching the spigot when accessing food articles within the fresh food compartment. The spigot further comprises a stem that is mounted through the reservoir front wall portion, a valve and a lever for opening and closing the valve. The majority of the spigot is located rearwardly of the front wall portion and only a portion of the lever projects forward of the front wall portion to allow it to be accessed readily by a user for dispensing fluids. Since the spigot is located adjacent the bottom front wall, when the lever is activated, the valve opens and water is dispensed by gravity from the reservoir through the stem of the spigot and drops from the spigot into a cup or other collecting vessel utilized by a user.

To facilitate the portability of the present invention, each of the reservoir side wall portions has a recessed handle located in a leading side wall portion that extends forward of the corresponding liner side wall. The recessed handle projects back into the reservoir and permits the user to insert her fingers into the handle portions and allow her thumbs to wrap around the reservoir front wall portion to permit the user to readily mount or remove the water dispenser from the refrigerator door when the door is in an open position. Additionally, the construction of the recessed handle portions also provides for a support shoulder where each handle portion projects into the reservoir. The shoulders are preferably relatively flat surfaces that extend along a horizontal plane inward from the opposite reservoir side wall portions. The shoulders are adapted to support a fill chamber mounted into an upper portion of the reservoir. The fill chamber preferably carries a filter and provides an upper chamber in which water is initially contained. The water passes through the filter attached between the fill chamber and the reservoir and the filtered water is held by the lower or main portion of the reservoir. It should be understood that the user may fill the fill chamber up and as water filters into the lower chamber may then continue to fill the fill chamber so that the entire reservoir and fill chamber is completely filled with water. When the user then dispenses water from the spigot, additional amounts of water located in the fill chamber passes through the filter by gravity into the lower reservoir. Consequently, the volume of filtered water supplied by the water dispensing module is relatively large when compared to jugs placed in the door shelves or trays.

The water dispensing module preferably further includes a lid that fits over the fill chamber and closes off the fill chamber. The lid preferably has a rear top wall raised platform portion and a forward platform portion that is lower than the rear platform portion. In other words, the rear platform portion which is adjacent the rear liner wall is raised relative to the forward portion. The forward portion preferably further includes a cap that closes an access opening. The cap may be removed from the forward platform portion to facilitate pouring of water either from a faucet when the module is placed beneath a faucet or from a container when the dispensing module is left mounted within the refrigerator door liner when filled. Any spillage associated with this pouring procedure runs off the rear platform into the forward platform and into the access opening.

BRIEF DESCRIPTION OF THE DRAWINGS

For a better understanding of the nature and objects of the present invention reference may be had to the following detailed description when taken in conjunction with the accompanying diagrammatic drawings wherein.

DETAILED DESCRIPTION OF EMBODIMENTS

Figure 1:
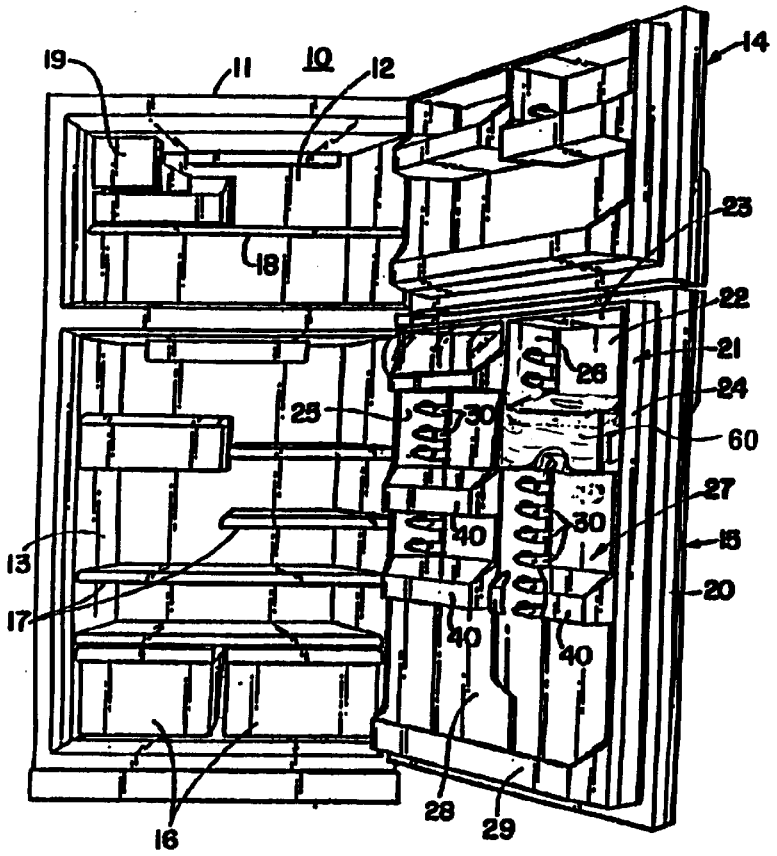
FIG. 1 is a perspective view of a refrigerator having a door mounted portable water dispensing apparatus in accordance with a preferred aspect of the present invention.

Referring now particularly to FIG. 1, there is shown a refrigerator 10 of the top mount type where the cabinet 11 encloses a freezer compartment 12 mounted above a fresh food compartment 13. The compartments include front access openings which normally are closed by hinged doors 14 and 15, respectively. Typically drawers 16 and shelves 17 are mounted in the fresh food compartment to support articles to be refrigerated. The freezer may have a shelf 18 to enhance the storage capability and some models may include an automatic ice maker 19.

The fresh food compartment door 15 includes an outer shell or casing 20 and an inner liner 21. The space between the outer shell 20 and inner liner 21 is filled with a suitable insulation material, such as, for example, a body of foamed in place insulation. A gasket (not shown) extends around the periphery of the door to seal against air leakage when the door is closed.

Figure 2:
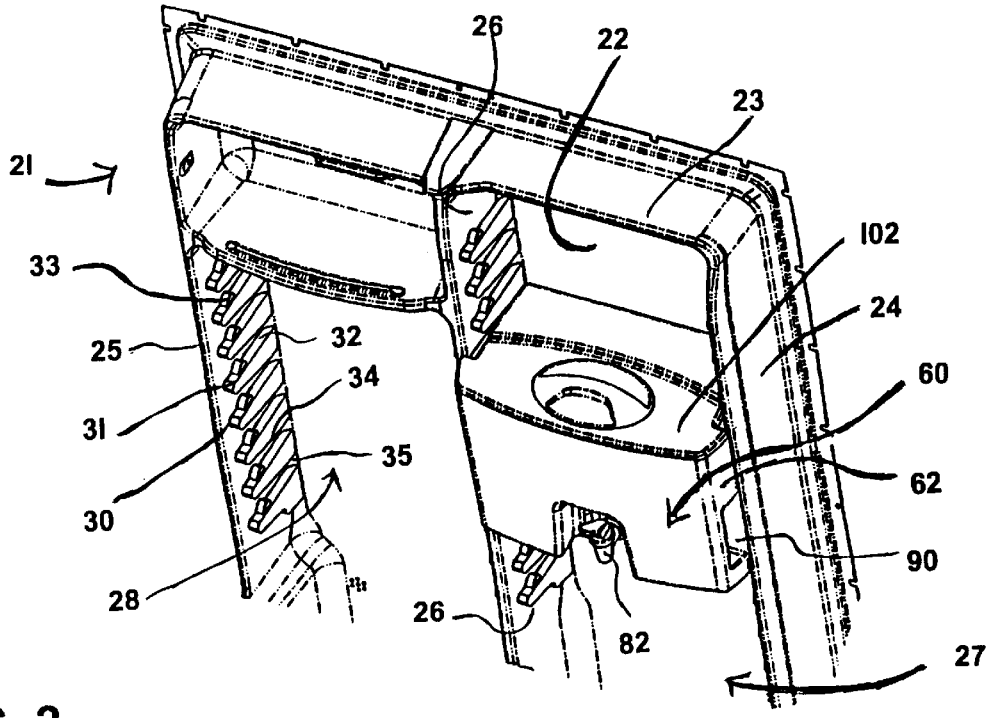
FIG. 2 is an enlarged partial perspective view of the preferred water dispensing module mounted to the liner.
Figure 3:
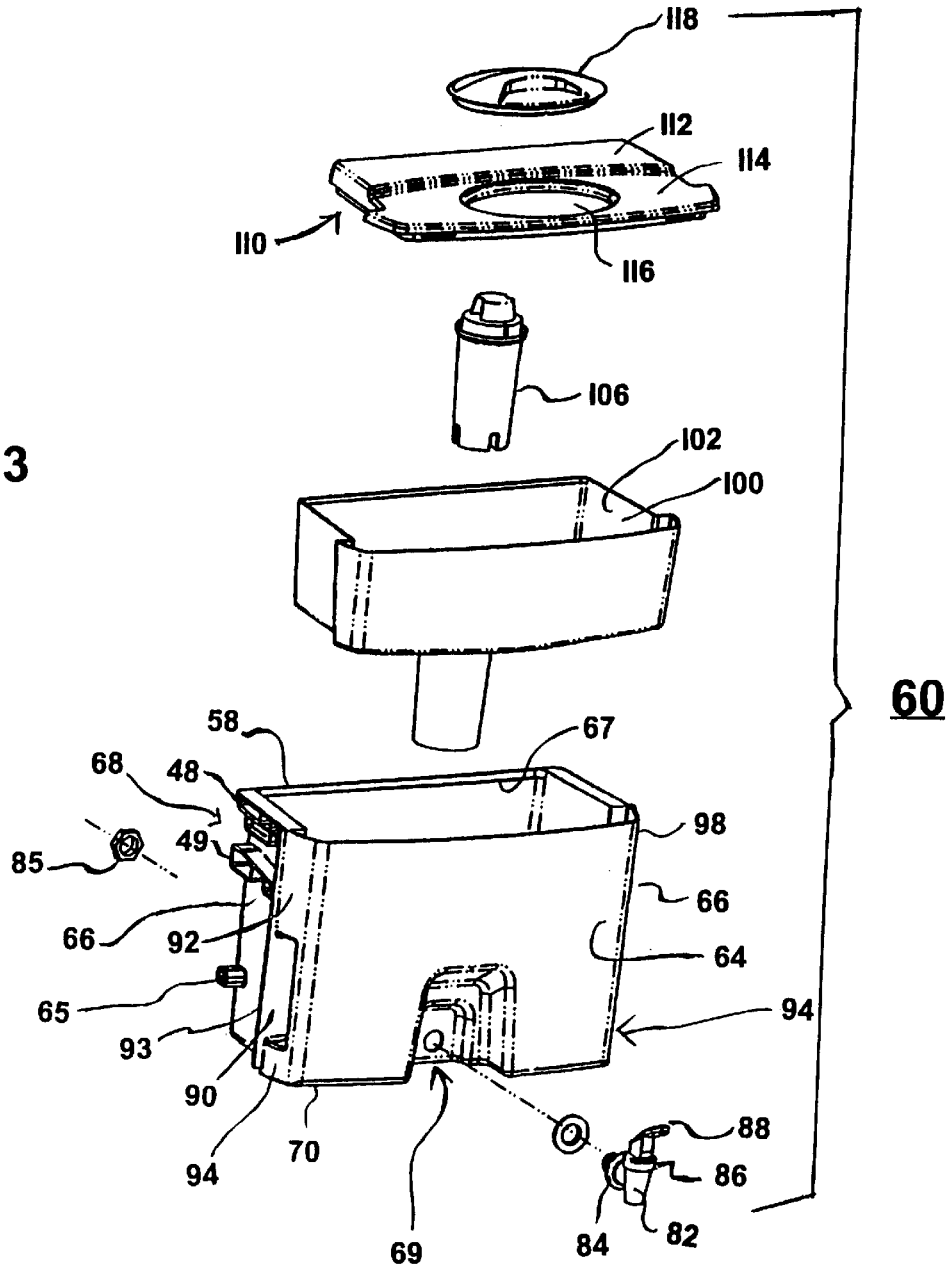
FIG. 3 is an exploded view of the component parts of the water dispensing module.

Referring to FIGS. 1 and 2, the inner liner 21 has a rear liner wall 22, a bottom wall (not shown), a top wall 23, liner side walls 24, 25 and a liner intermediate wall 26 (also considered a side wall). The intermediate wall 26 is parallel to the side walls 24, 25 and is spaced between them. The top, bottom, side and intermediate liner walls extend forward from the rear wall 22 to form liner recesses 27, 28 in the liner which face into and become part of the fresh food compartment 13 when the door 15 is closed. More particularly, the walls 24, 26, along with the other walls of the liner, define a first recess 27 while the walls 25, 26, along with the other walls of the liner, define a second recess 28. Thus each of the walls 24, 25 and 26 is a side wall of a recess. It will be understood that the fresh food compartment doors of some smaller size refrigerators and of many side-by-side refrigerators do not include an intermediate wall 26 and the door liner has only one recess.

For storage of items on the door 15, a permanent shelf 29 (FIG. 1) is mounted across the bottom of the door 15 to store tall items. Also each of the side walls 26, 27, 28 is provided with a series of vertically aligned and spaced apart module supports or, as shown in the preferred embodiment, supporting ribs 30. Both sides of the intermediate side wall 26 are provided with ribs so that each side wall of each of the recesses 27, 28 has a series of ribs. The ribs 30 on each side wall are aligned with the ribs on the facing side wall. While the ribs 30 are aligned across both recesses 27, 28, it will be understood that such alignment from one recess to the other is not necessary.

Figure 5:
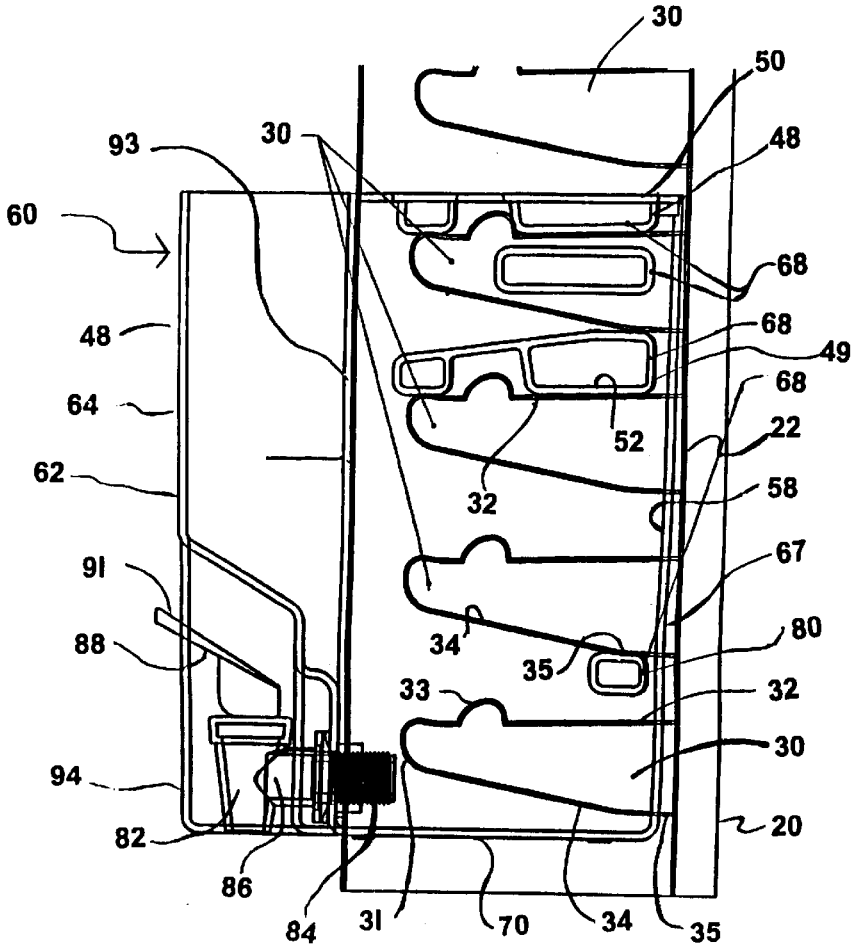
FIG. 5 is a side sectional view showing the interconnection between the water dispensing module and the refrigerator door liner.

Each of the ribs 30 in this preferred embodiment, as best seen in FIGS. 2 and 5, extends forward from the liner rear wall 22 and terminates in a distal end or tip 31. The top wall 32 of each rib is generally horizontal and includes an upwardly tab 33 proximate the distal end 31. Each rib has a bottom wall 34 including a horizontal portion or section 35 adjacent the liner rear wall 22. The preferred construction of the ribs is disclosed in detail in the aforementioned U.S. Pat. No. 5,346,299.

Referring to all the Figures, a number of storage modules, illustrated by bins 40, are assembled to, or mounted on, the door liner by utilizing the ribs 30. In addition, a water dispensing module 60 is shown at least partially receivable within the liner recess 27.

The water dispensing module 60 has a reservoir 62 that has a front wall portion 64, opposing side walls portion 66, a rear wall portion 58, and a bottom wall portion 70. Each of the reservoir side wall portions 66 has at least one anchoring support 68 for releasably mating with the module supports of the liner side walls to mount the water dispensing module 60 on the refrigerator door with the rear wall portion 58 at least closely adjacent to the rear liner 22 and the side wall portions 66 adjacent to side walls 24 and 26. In the preferred embodiment shown, at least a portion of the reservoir side walls 66 and the reservoir rear wall portion 68 are shaped or contoured to snugly fit between corresponding liner side walls and the liner rear wall.

The anchoring supports 68 for the water dispensing module 60 are provided adjacent the top portion 98 of the reservoir side wall portions 66 and comprise an upper rail 48 and a lower rail 49. The rails 48, 49 extend from adjacent the rear edge of the module side walls 66 toward the front of the module. Each upper rail 48 is formed adjacent the top of the module 60 and, in the illustrative modules the horizontal upper wall 50 is part of the rim around the upper edge of the module 60. The lower wall 52 of each upper rail 48 is also generally horizontal and is spaced relatively close to the upper wall 50 so that, when a module 60 is assembled to the liner 21, the lower wall 52 will rest on the upper wall 32 of one liner rib 30 and the upper wall 50 of the upper rail 48 will be spaced below the next higher rib 30.

In addition, due to the overall height of the water dispensing module 60 being larger than a bin 40, lower portions of the side wall portions 66 are provided with a protruding boss 80 which is inserted between an additional pair of ribs 30 in the side walls which additional pair of ribs 30 are located below and adjacent to the pair or ribs 30 supporting rails 48 and 49. As shown in FIG. 5 the boss 80 rests against the horizontal section 35 of lower wall 34 of the upper rib of the lower pair of ribs 30.

The water dispensing module 60 is assembled to or mounted on a liner by inserting the module into one of the liner recesses 27, 28 with the rails 48, 49 being received between vertically adjacent pairs of ribs 30. When the tabs 33 are aligned with the recesses 58, 59 the module is lowered or tilted forward to insert the tabs into the recesses. Boss 80 swings into engagement with wall section 35 of a lower rib 30 to complete the support.

The front wall portion 64 of the reservoir 62 has a forward facing mounting wall 69 recessed a predetermined depth therefrom into which the spigot is mounted at the lower front portion 94 rearwardly of the front wall portion 64. The spigot 82 comprises a threaded stem 84 which passes through the front wall portion 64. The stem is held in place by lock nut 85 and a sealing washer 87. The spigot 82 includes a valve 86 and a lever 88 movable to open and close the valve 86. Only a portion 91 of the lever 88 projects forward of the front wall portion 66 as best seen in FIG. 5. Below the spigot 82, a user may place a cup or other collection device to capture water flowing out through the spigot 82 as a result of gravity fed water flow when the valve 86 is open.

Figure 4:
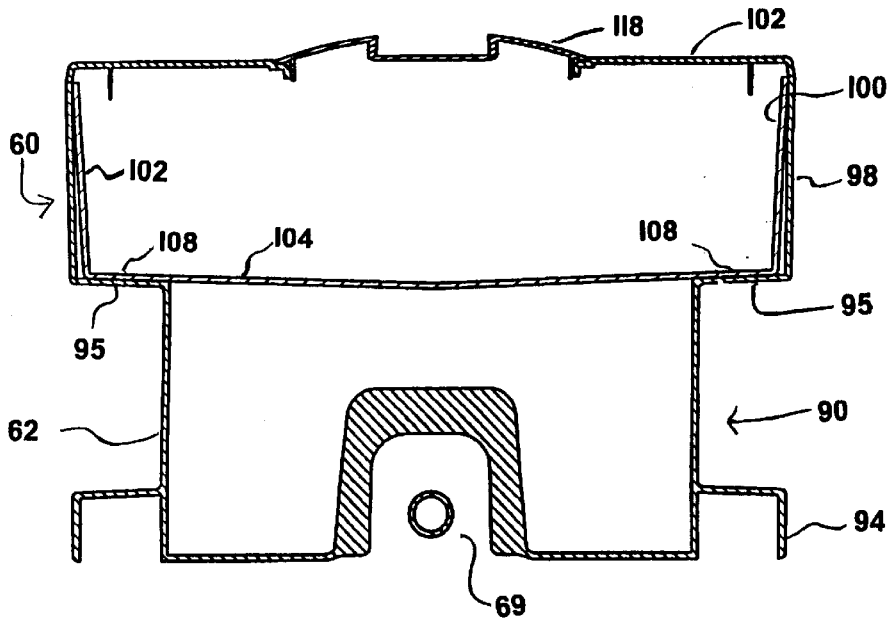
FIG. 4 is a front sectional view of the water dispensing module.

The reservoir 62 is a main reservoir and it is provided with handle portions 90 that are recessed into leading side wall portions 92 and 94 of the reservoir side wall portions 66. The leading side wall portions 92 and 94 extend forward of the inner liner side walls 24, 25, 26 and have a rear wall 93 adapted to lie flush with the forward edges of the liner side walls 24, 26. Each of the handle portions 90 projects into the reservoir 62 and defines a horizontal extending flat shoulder 95 (FIG. 4) that projects into the reservoir 62. The handle portions 90 facilitate the mounting and the removal of the water dispensing module 60 from the refrigerator door 15 when the door is open.

The water dispensing module 60 further includes a fill chamber 100 having side walls 102 and a floor 104 with a filter 106 mounted through the floor 104. The fill chamber 100 is positional in an upper portion 98 of the reservoir 62 with floor portions 104 of the fill chamber 100 resting on and supported by the shoulders 95 defined by the handle portions 90 as can best be seen in FIG. 4. Hence the recessed handle portions 90 have a dual functionality.

The water dispensing module 60 further includes a lid or cover 110 having a rear platform surface 112 and a forward platform surface 114. The rear platform surface 112 that is raised relative to the forward platform 114. This allows for any water spilled water during filling of the dispenser, if still mounted to the door, to flow towards opening 116 in the forward platform 114. Opening 116 is normally closed by a removable cap 118.

It will be appreciated that alternative embodiments falling within the scope of the present invention may be apparent to those skilled in the art and accordingly the present invention should not be limited to those embodiments herein described.

What is claimed is:

1. A refrigerator door mounted water dispensing apparatus comprising:

a refrigerator door having an outer shell and an inner liner having at least two spaced apart liner side walls and a rear liner wall defining a liner recess between the side walls, the liner side walls having module supports spaced vertically along each of said liner side walls; and, a water dispensing module releasably mounted to the refrigerator door and at least partially receivable within the liner recess, said water dispensing module comprising a reservoir having a front wall portion, opposing side wall portions, a rear wall portion and a bottom wall portion, each of the reservoir side wall portions having at least one anchoring support for releasably mating with module supports of the liner side walls to mount the water dispensing module on the refrigerator door with the reservoir rear wall portion adjacent the liner rear wall and the reservoir side wall portions received between, and adjacent to, corresponding liner side walls with the reservoir front wall portion extending across the refrigerator door between the liner side walls, said water dispensing module having a spigot mounted to the reservoir front wall portion adjacent the reservoir bottom wall portion for dispensing water from the reservoir, the reservoir side wall portions each having a leading side wall portion that extends forward of the corresponding liner side wall, the leading side wall portions each having a handle portion recessed into a lower portion of the leading side wall to facilitate mounting and removing of the water dispenser module from the refrigerator door when the door is open, each of the recessed handle portions projecting into the reservoir and defining a shoulder within the reservoir; and the water dispensing module further including a fill chamber having side walls and a floor with a filter mounted through the floor, the fill chamber being insertable into an upper portion of the reservoir with portions of the floor of the fill chamber resting on and supported by the shoulders defined by the recessed handle portions whereby water poured into the fill chamber is collected by the fill chamber and passes through the filter into a lower portion of the reservoir.

2. The refrigerator door mounted water dispensing apparatus of claim 1 wherein the reservoir front wall portion has a forward facing mounting wall recessed a predetermined depth therefrom into which the spigot is mounted to position the spigot rearwardly of the front wall portion.

3. The refrigerator door mounted water dispensing apparatus of claim 2 wherein the spigot comprises a stem mounted through the reservoir front wall, a valve and a lever for opening and closing the valve, and only a portion of the lever projects forward of the reservoir front wall portion.

4. A refrigerator door mounted water dispensing apparatus comprising:

a refrigerator door having an outer shell and an inner liner having at least two spaced apart liner side walls and a rear liner wall defining a liner recess between the side walls, the liner side walls having module supports spaced vertically along each of said liner side walls; and, a water dispensing module at least partially receivable within the liner recess, said water dispensing module comprising a reservoir having a front wall portion, opposing side wall portions, a rear wall portion and a bottom wall portion, each of the reservoir side wall portions having at least one anchoring support for releasably mating with module supports of the liner side walls to mount the water dispensing module on the refrigerator door with the reservoir rear wall portion adjacent the liner rear wall and the reservoir side wall portions received between, and adjacent to, corresponding liner side walls with the reservoir front wall portion extending across the refrigerator door between the liner side walls, said water dispensing module having a spigot mounted to the reservoir front wall portion adjacent the reservoir bottom wall portion for dispensing water from the reservoir, said water dispensing module having a fill chamber having side walls and a floor with a filter mounted through the floor, the fill chamber being insertable into an upper portion of the reservoir whereby water poured into the fill chamber is collected by the fill chamber and passes through the filter into a lower portion of the reservoir, and the water dispensing module further comprises a lid that fits over the fill chamber.

5. The refrigerator door mounted water dispensing apparatus of claim 4 wherein the reservoir front wall portion has a forward facing mounting wall recessed a predetermined depth therefrom into which the spigot is mounted to position the spigot rearwardly of the front wall portion.

6. The refrigerator door mounted water dispensing apparatus of claim 5 wherein the spigot comprises a stem mounted through the reservoir front wall portion, a valve and a lever for opening and closing the valve, and only a portion of the lever projects forward of the reservoir front wall portion.

7. The refrigerator door mounted water dispensing apparatus of claim 4 wherein the lid has an opening permitting water to be poured into the fill chamber through the lid and the assembly further comprises a removable cap for closing the opening.

8. The refrigerator door mounted water dispensing apparatus of claim 7 wherein the lid has a rear platform raised relative to a forward platform and the opening is located in the forward platform.

9. The refrigerator door mounted water dispensing apparatus of claim 4 wherein:

the modular supports of the refrigerator door comprise a plurality of module supporting ribs projecting inwardly of each of said liner side walls and aligned with a corresponding plurality of ribs projecting inwardly of said other liner side wall;

the anchoring support of the water dispensing module comprises a pair of rails projecting outward of each of said reservoir side wall portions adjacent the top of the reservoir and extending from adjacent a rear portion of the corresponding module side wall portion toward the front of said module; and each of said reservoir side wall portions further including a boss projection outward therefrom;

whereby said water dispensing module is assembled to said door by sliding said pair of module rails on top of a first pair of adjacent liner ribs and by positioning the boss projection between a second pair of liner ribs located below and adjacent to the first pair of liner ribs to further support the water dispensing module to the door.

10. The refrigerator door mounted water dispensing apparatus of claim 9 wherein the reservoir side wall portions each have a leading side wall portion that extends forward of the corresponding liner side wall, the leading side wall portions each having a handle portion recessed into a lower portion of the leading side wall, each of the handle portions projects into the reservoir and provides a shoulder within the reservoir whereby the handle portions facilitate mounting and removing of the water dispenser module from the refrigerator door when the door is open; and the water dispensing module further including a fill chamber having side walls and a floor with a filter mounted through the floor, the fill chamber being insertable into an upper portion of the reservoir with portions of the floor of the fill chamber resting on and supported by the shoulders of the handle portions whereby water poured into the fill chamber is collected by the fill chamber and passes through the filter into a lower portion of the reservoir.

11. The refrigerator door mounted water dispensing apparatus of claim 10 wherein the reservoir front wall portion has a forward facing mounting wall recessed a predetermined depth therefrom into which the spigot is mounted to position the spigot rearwardly of the front wall portion.

12. The refrigerator door mounted water dispensing apparatus of claim 11 wherein the spigot comprises a stem mounted through the reservoir front wall, a valve and a lever for opening and closing the valve, and only a portion of the lever projects forward of the reservoir front wall portion.

13. The refrigerator door mounted water dispensing apparatus of claim 9 wherein the lid has an opening permitting water to be poured into the fill chamber through the lid and the assembly further comprises a removable cap for closing the opening.

14. The refrigerator door mounted water dispensing apparatus of claim 13 wherein the lid has a rear platform raised relative to a forward platform and the opening is located in the forward platform.

* * * * *